US009243420B2

(12) United States Patent
Zhou

(10) Patent No.: US 9,243,420 B2
(45) Date of Patent: Jan. 26, 2016

(54) TENT FOR PHOTOGRAPHY

(75) Inventor: Nanqing Zhou, Xiamen (CN)

(73) Assignee: Q-YIELD OUTDOOR GEAR LTD., Xiamen, Fujian (CN)

( * ) Notice: Subject to any disclaimer, the term of this patent is extended or adjusted under 35 U.S.C. 154(b) by 0 days.

(21) Appl. No.: 14/350,532

(22) PCT Filed: Sep. 5, 2012

(86) PCT No.: PCT/CN2012/081010

§ 371 (c)(1),
(2), (4) Date: Apr. 8, 2014

(87) PCT Pub. No.: WO2014/036698

PCT Pub. Date: Mar. 13, 2014

(65) Prior Publication Data

US 2014/0283889 A1 Sep. 25, 2014

(51) Int. Cl.

| | |
|---|---|
| ***E04H 15/02*** | (2006.01) |
| ***E06C 1/397*** | (2006.01) |
| ***E06C 1/387*** | (2006.01) |
| ***E06C 1/393*** | (2006.01) |
| ***E06C 7/18*** | (2006.01) |
| ***E04H 15/00*** | (2006.01) |

(52) U.S. Cl.

CPC ..... *E04H 15/02* (2013.01); *E04H 15/001* (2013.01); *E06C 1/387* (2013.01); *E06C 1/393* (2013.01); *E06C 1/397* (2013.01); *E06C 7/182* (2013.01)

(58) Field of Classification Search

CPC ..... E04H 15/02; E04H 15/18; E04H 15/28; E04H 15/32; E04H 15/42; E04H 2015/326; E04H 15/06; E04H 15/34; B62B 7/12; B62B 1/14; E06C 1/397; E06C 7/182; E06C 7/183

USPC ..... 135/88.05, 88.13, 88.15, 96, 156, 123, 135/127, 901; 182/19, 20, 129; 280/47.18, 280/4, 47.31

See application file for complete search history.

(56) References Cited

U.S. PATENT DOCUMENTS

| | | | | |
|---|---|---|---|---|
| 3,289,787 | A * | 12/1966 | McSwain | 182/20 |
| 3,375,836 | A * | 4/1968 | Domeneghetti | 135/88.18 |
| 3,473,627 | A * | 10/1969 | Repka | 182/16 |
| 4,274,508 | A * | 6/1981 | Hughes et al. | 182/116 |
| 5,320,195 | A * | 6/1994 | Reece et al. | 182/48 |
| 5,333,634 | A * | 8/1994 | Taylor | 135/98 |
| 6,290,023 | B1 * | 9/2001 | Martin | 182/127 |
| 6,550,575 | B2 * | 4/2003 | Spencer et al. | 182/63.1 |
| 6,802,327 | B2 * | 10/2004 | Koss | 135/88.08 |
| 7,320,382 | B2 * | 1/2008 | Savoie et al. | 182/127 |
| 8,408,361 | B2 * | 4/2013 | Chung et al. | 182/21 |
| 8,523,196 | B1 * | 9/2013 | Appleby | 280/30 |
| 2007/0235255 | A1 * | 10/2007 | Wallace et al. | 182/20 |

* cited by examiner

*Primary Examiner* — Winnie Yip

(57) ABSTRACT

A tent for photography includes a ladder assembly and an affiliated tent. The ladder assembly includes two front support legs and two rear support legs. Tops of the front and rear support legs are hinged together. At least one footboard is disposed on the front support legs or between the front and rear support legs. The affiliated tent includes a support rod and a tent cloth. The support rod is composed of rod members connected with each other. Two ends of the support rod after bending form two support legs of the tent. One side of the tent cloth is fixed on the support rod, and the other side is fixed on the ladder assembly. By the tent, a photographer can climb up or lie on the ground during field photographing. The tent provides a place for shading and sheltering from the rain to facilitate outdoor photography work.

13 Claims, 13 Drawing Sheets

TENT FOR PHOTOGRAPHY

BACKGROUND OF THE INVENTION

1. Field of the Invention

The present invention relates to an outdoor photograph apparatus, and more particularly to a tent for photography.

2. Description of the Prior Art

Photographers often take photographs in the field. For a certain view or specific scene, flows, or birds, the photographers have to wait several hours or even days to capture the desired effect for getting perfect photos. Taking photographs in the field and taking photographs in the studio are different. The photographers often need to climb up or creep. However, it is difficult to find suitable climbing equipment in the field. When the photographers have to creep, the field environment is poor and it is easy to disturb the animals to be photographed. All these have brought a lot of inconvenience for taking photographs. Moreover, the weather in the field is uncertain. Sometimes, the weather is hot. Sometimes, it rains. This also gives grim ordeal to the photographers. Although you can use hats or umbrellas, the effect of use is not ideal. Accordingly, the inventor of the present invention has devoted himself based on his many years of practical experiences to solve this problem.

SUMMARY OF THE INVENTION

The primary object of the present invention is to provide a tent for photography in the field.

In order to achieve the aforesaid object, the tent for photography of the present invention comprises a ladder assembly and an affiliated tent. The ladder assembly comprises two front support legs and two rear support legs. The tops of the front support legs and the rear support legs are hinged together to form a structure similar to a ladder. At least one footboard is disposed on the front support legs or between the front support legs and the rear support legs. The affiliated tent comprises a support rod and a tent cloth. The support rod is composed of a plurality rod members connected with each other. Two ends of the support rod after bending form two support legs of the affiliated tent. One side of the tent cloth is fixed on the support rod, and the other side of the tent cloth is fixed on the ladder assembly.

Preferably, the bottoms of the front support legs or the rear support legs of the ladder assembly are provided with wheels. The tops of the front and rear support legs are provided with a handle.

Preferably, the ladder assembly is provided with two footboards, an upper footboard disposed between the front and rear support legs and a lower footboard disposed on the front support legs and protruding from front sides of the front support legs.

Preferably, the front side of the upper footboard is provided with a fixing shaft. The rear side of the upper footboard is provided with a slide shaft. The fixing shaft is installed between the two front support legs. The two rear support legs are provided with slide rails. The slide shaft is installed in the slide rails.

Preferably, two supporting rods are provided under the lower footboard. The lower ends of the front support legs have curved portions which are bent forward. The supporting rods are sustained on the curved portions.

Preferably, a handle is disposed on a retractable pull rod. The retractable pull rod is installed on the tops of the front support legs. The rear support legs are provided with wheels.

Preferably, the rear support legs are provided with straps. A backboard is provided between the two rear support legs.

Preferably, one end of each of the rod members is formed with a reduced neck section. The reduced neck section of one of the rod member is inserted into a non-reduced end of another one of the rod members for connection of the rod members. An elastic rope is provided in the rod members. Two ends of the elastic rope are fixed to the two ends of the support rod.

Preferably, the support rod is provided with at least one elbow connector. Two ends of the elbow connector are formed with reduced neck sections to connect the adjacent rod members.

Preferably, the rod members of the support rod of the affiliated tent are connected through a connecting structure.

Accordingly, the present invention is a tent for outdoors photography. The ladder assembly provides a function for ascent. The photographer can sit or step on the ladder assembly for taking a photograph. The ladder assembly can be used to is prop up the affiliated tent for the photographer to take a rest in the tent or stay in the tent for observing and taking a photograph, not disturbing the small animals. By using the tent for photography, a photographer can conveniently climb up or lie on the ground during field photographing. The present invention can provide a place for shading and sheltering from the rain so as to facilitate outdoor photography work.

DETAILED DESCRIPTION OF THE PREFERRED EMBODIMENTS

Embodiments of the present invention will now be described, by way of example only, with reference to the accompanying drawings.

Figure 1:
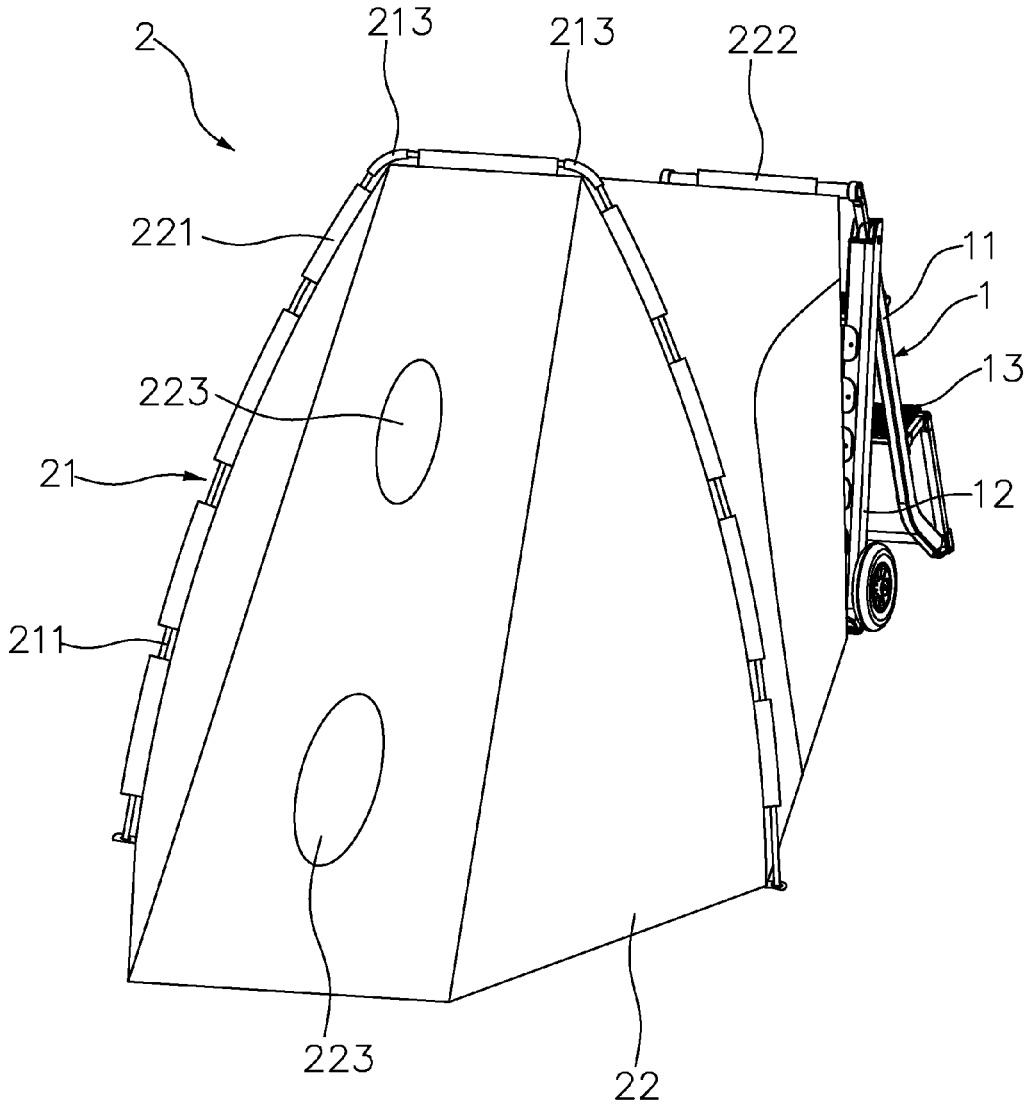
FIG. 1 is a perspective view according to a preferred embodiment of the present invention.
Figure 2:
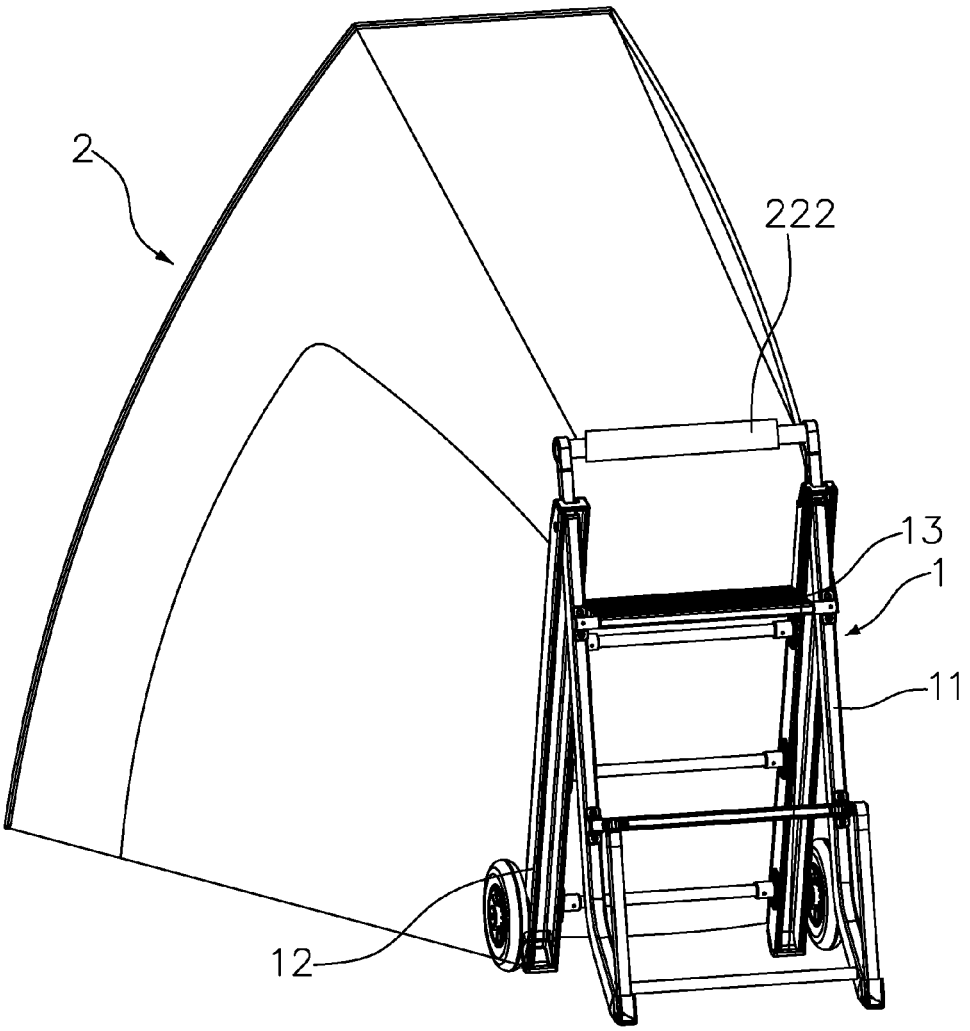
FIG. 2 is another perspective view according to the preferred embodiment of the present invention.
Figure 3:
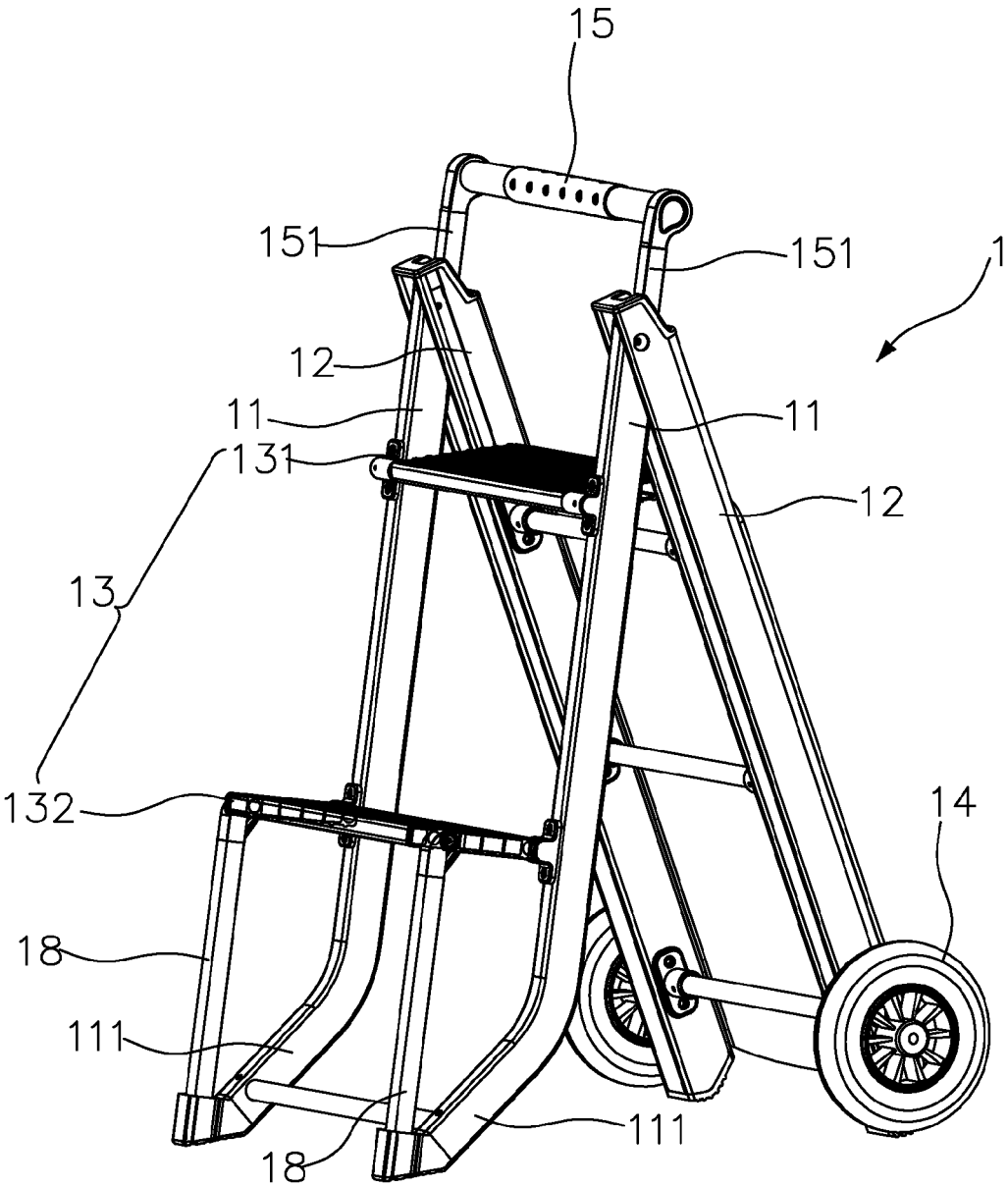
FIG. 3 is a perspective view of the ladder assembly according to the preferred embodiment of the present invention, wherein the ladder assembly provides an ascent function.

The present invention discloses a tent for photography. As shown in FIG. 1 to FIG. 3, the tent for photography according to a preferred embodiment of the present invention comprises a ladder assembly 1 and an affiliated tent 2.

The ladder assembly 1 comprises two front support legs 11 and two rear support legs 12. The tops of the front support legs 11 and the rear support legs 12 are is hinged together to form a structure similar to a ladder. At least one footboard 13 is disposed on the front support legs 11 or between the front support legs 11 and the rear support legs 12.

The affiliated tent 2 comprises a support rod 21 and a tent cloth 22. The support rod 21 is composed of several rod members 211 connected with each other. Two ends of the support rod 21 after bending form two support legs of the affiliated tent 2. One side of the tent cloth 22 is fixed on the support rod 21. The fixing way is that the tent cloth 22 is provided with a plurality of sleeves 221 and the sleeves 221 are fitted on the support rod 21. The other side of the tent cloth 22 is fixed on the ladder assembly 1. The fixing way is that the tent cloth 22 is provided with a fixing rope (not shown in the drawings) and the tent cloth 22 is tied on the ladder assembly 1 through the fixing rope.

When in use, the front support legs 11 and the rear support legs 12 of the ladder assembly 11 are unfolded, and then the rod members 211 of the affiliated tent 2 are connected to form the support rod 21. One side of the tent cloth 22 is fixed on the support rod 21, and the support rod 21 is bent for the two ends of the support rod 21 as the support legs to be secured on the ground. After that, the other side of the tent cloth 22 is fixed on the ladder assembly 1. This constitutes an unfolded tent for photography. The photographer can step on the footboard 13 to ascend a height or stay in the tent for taking a rest. The tent cloth 22 of the affiliated tent 2 may be formed with a plurality of windows 223 at different heights, so that the photographer can stay in the tent to observe the small animals to be photographed, not disturbing the small animals.

Figure 4:
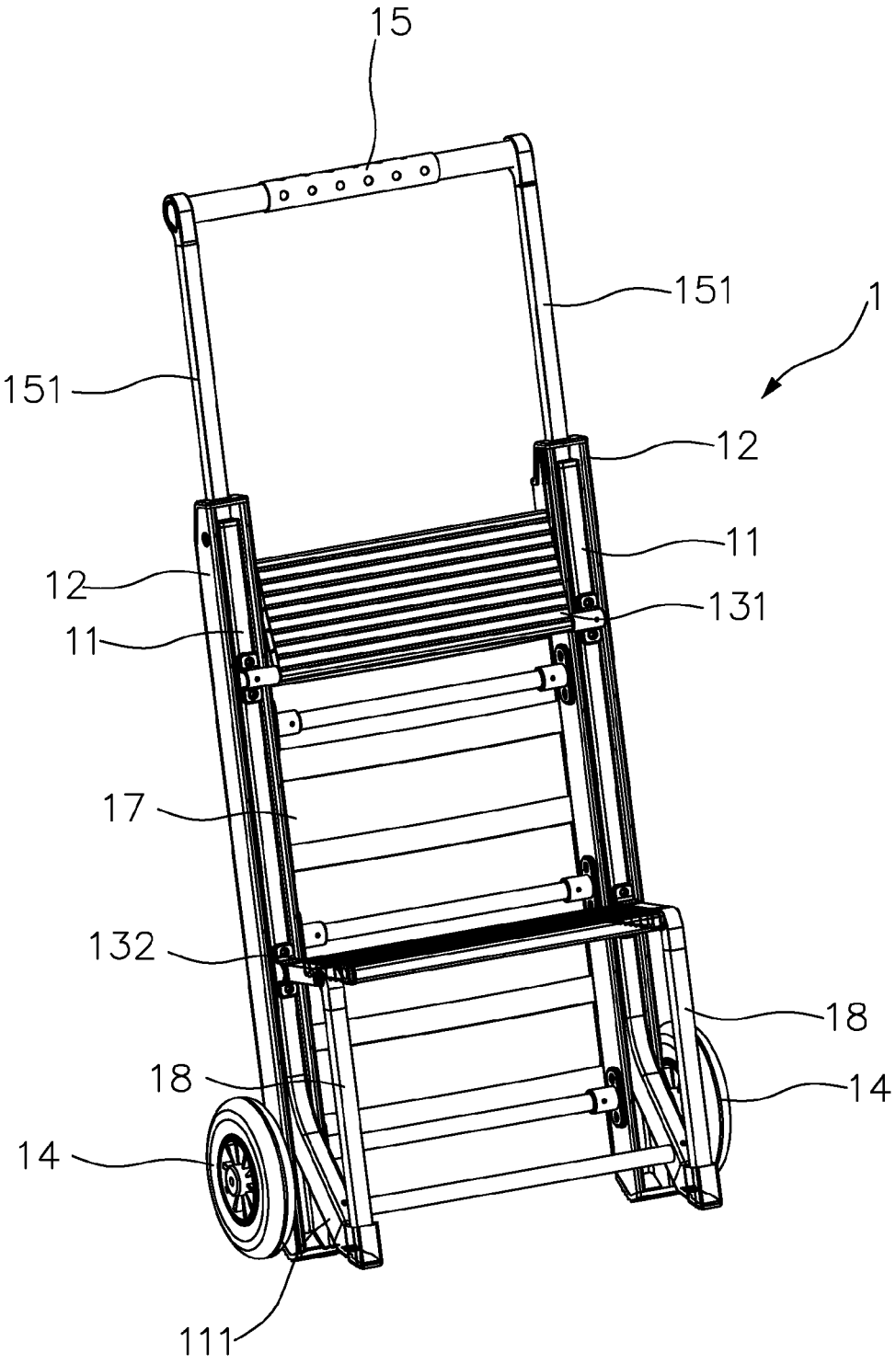
FIG. 4 is a perspective view of the ladder assembly according to the preferred embodiment of the present invention, wherein the ladder assembly provides a trolley function.

Furthermore, referring to FIG. 4, the bottoms of the front support legs 11 or the rear support legs 12 of the ladder assembly 1 are provided with wheels 14. In this embodiment, the wheels 14 are disposed at the bottoms of the rear support legs 12. The tops of the front and rear support legs 11, 12 are provided with a handle 15. The handle 15 is disposed on a retractable pull rod 151. The pull rod 151 is installed on the tops of the front support legs 11 or the rear support legs 12. In this embodiment, the retractable pull rod 151 is installed on the tops of the front support legs 11. The retractable structure of the pull rod 151 is a conventional structure used on a trolley case or a travelling case, and won't be described in detail herein. With the wheels 14 and the handle 15, the ladder assembly 1 can be used as a trolley. The photograph package and the affiliated tent 2 can be placed on the footboard 13 to be taken along with the trolley for taking photographs conveniently.

Figure 5:
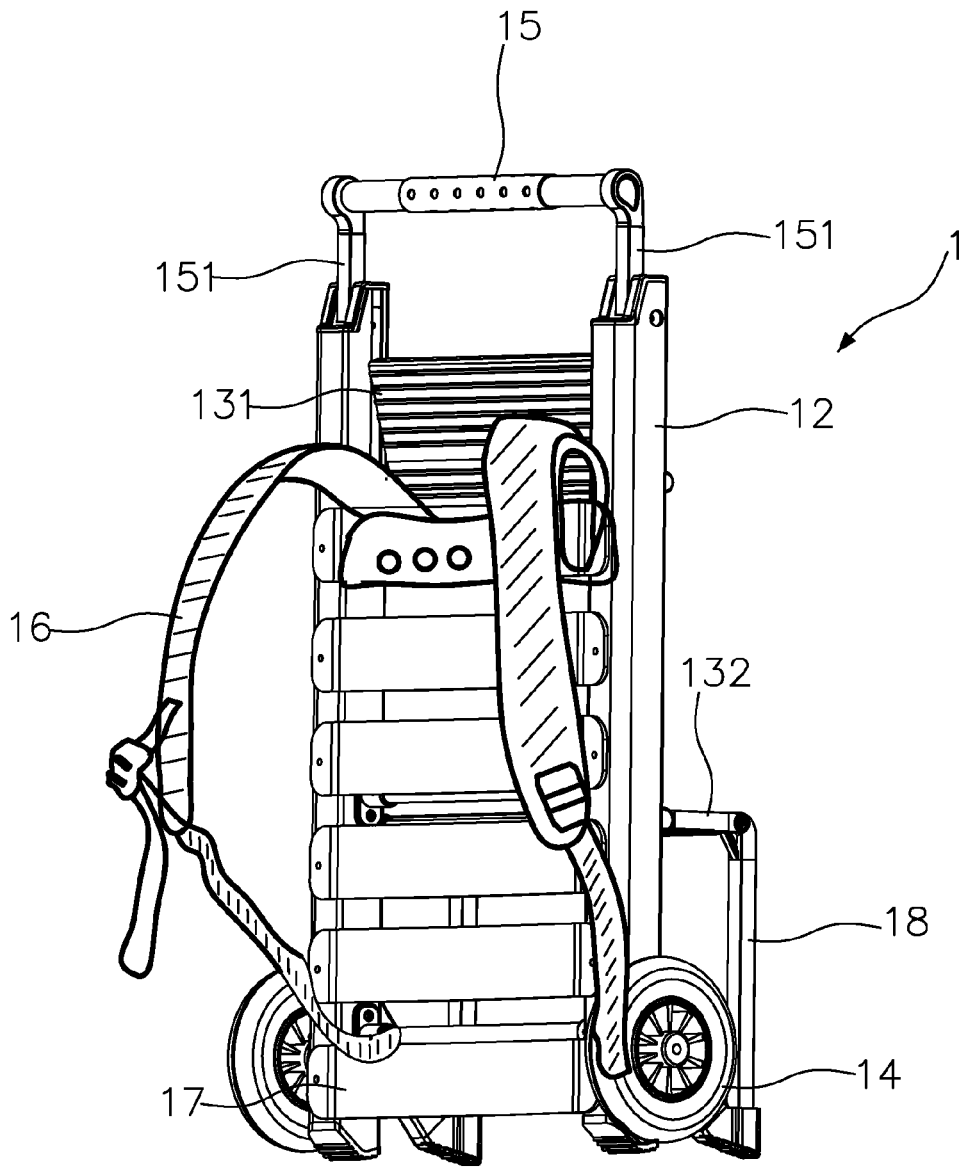
FIG. 5 is a perspective view of the ladder assembly according to the preferred embodiment of the present invention, wherein the ladder assembly provides a backpack function.

As shown in FIG. 5, the front support legs 11 or the rear support legs 12 are provided with straps 16. In this embodiment, the straps 16 are disposed on the rear support legs 12. A backboard 17 is provided between the two rear support legs 12 to support the back. With the straps 16, the user can carry the ladder assembly 1 on the back when it is not convenient to drag the ladder assembly 1.

Figure 6:
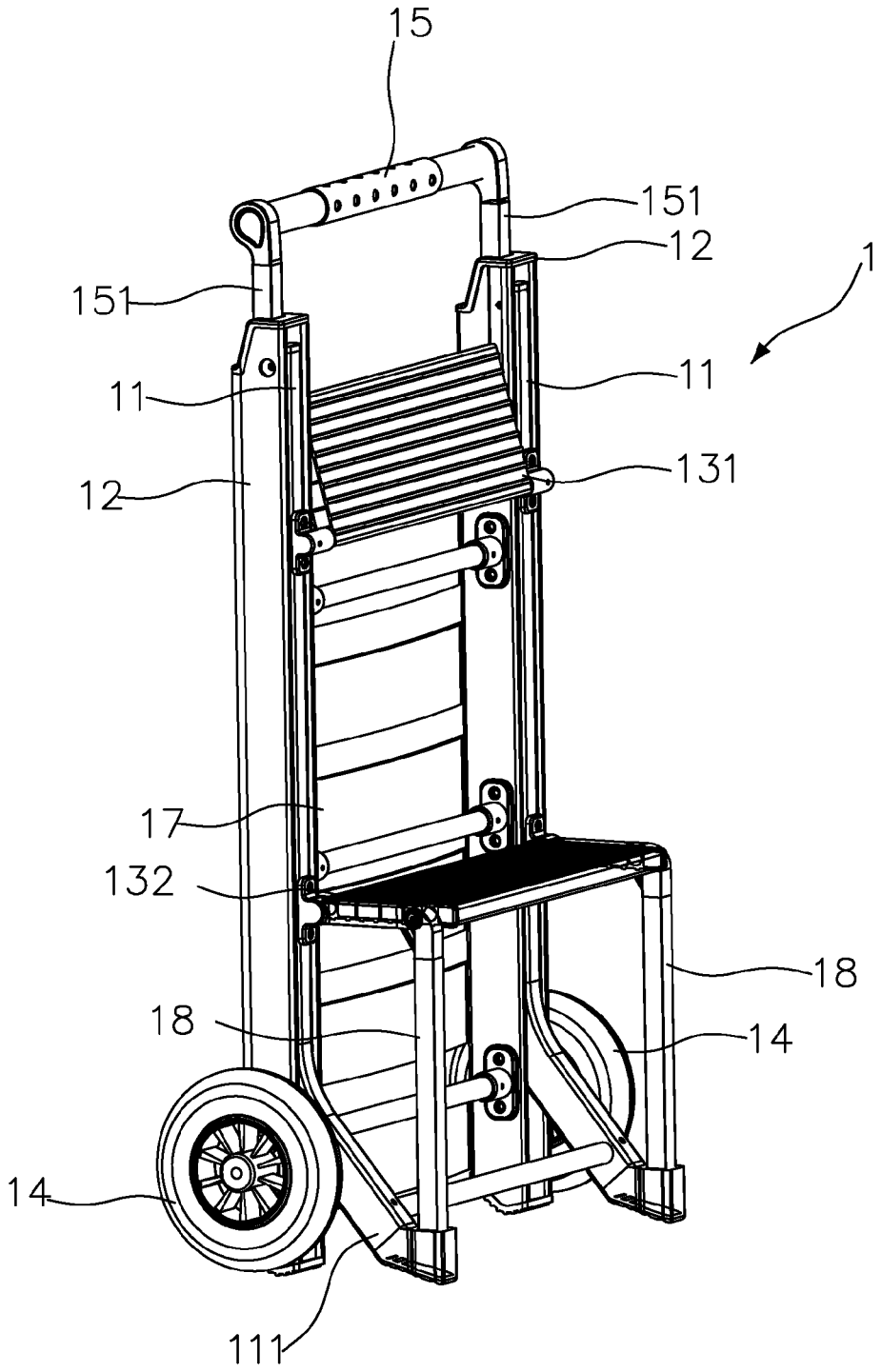
FIG. 6 is a perspective view of the ladder assembly according to the preferred embodiment of the present invention, wherein the ladder assembly provides a seat function.

Referring to FIG. 3 and FIG. 6, the footboard 13 protrudes from the outer sides of the front support legs 11. In this way, on the one hand the footboard 13 can be stepped on conveniently, and on the other hand it can be used as a shelf. In addition, the ladder assembly 1 can be provided with two or more footboards 13. In this embodiment as shown in the drawings, an upper footboard 131 is disposed between the front and rear support legs 11, 12, and a lower footboard 132 is disposed on the front support legs 11 and protruding from the front sides of the front support legs 11. In order to enhance the stability of support, two supporting rods 18 are provided under the lower footboard 132. The supporting rods 18 are direct sustained on the ground is or on the front support legs 11. In this embodiment as shown in the drawings, the lower ends of the front support legs 11 have curved portions 111 which are bent forward. The supporting rods 11 are sustained on the curved portions 111. Through the aforesaid configuration, the photographer can step on the footboard 13 to ascend a height and can elect a different footboard for the demand of different heights. The lower footboard 132 can be used as a shelf for placing photograph devices, photograph packages, and so on. When the front and rear support legs 11, 12 are closed up and upright for support, the lower footboard 132 can be used as a chair, as shown in FIG. 6.

Figure 7:
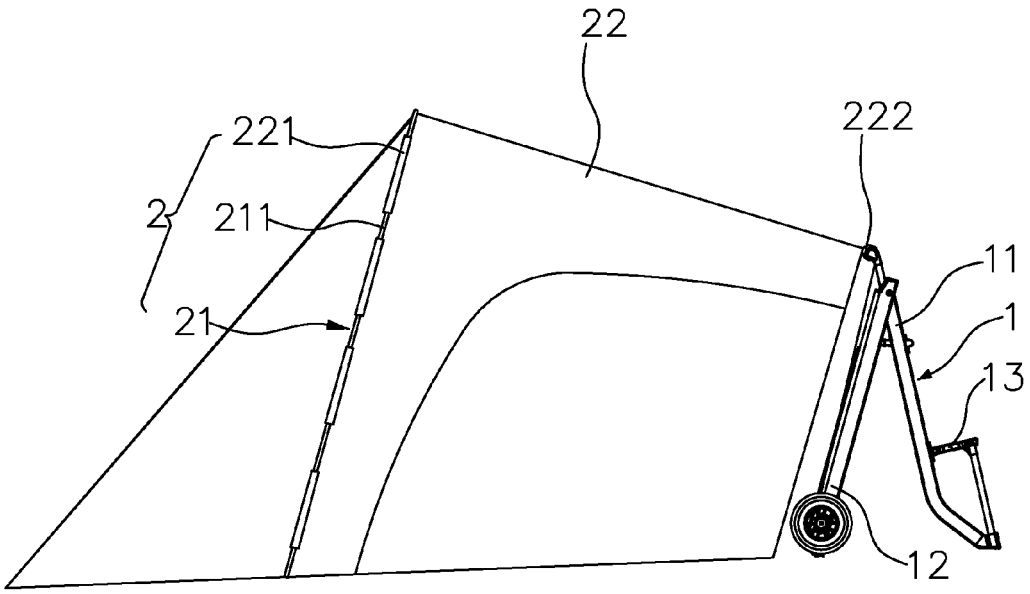
FIG. 7 is a schematic view showing the ladder assembly used to prop up the affiliated tent according to the preferred embodiment of the present invention.

One of the functions of the ladder assembly 1 is as the support of the affiliated tent 2. As shown in FIG. 7, for the affiliated tent 2 to be secured on the ladder assembly 1 conveniently, another side of the tent cloth 22 is provided with an adhesive sleeve 222. The adhesive sleeve 222 is fitted on the handle 15 of the ladder assembly 1 so as to prop up the affiliated tent 2.

Figure 8:
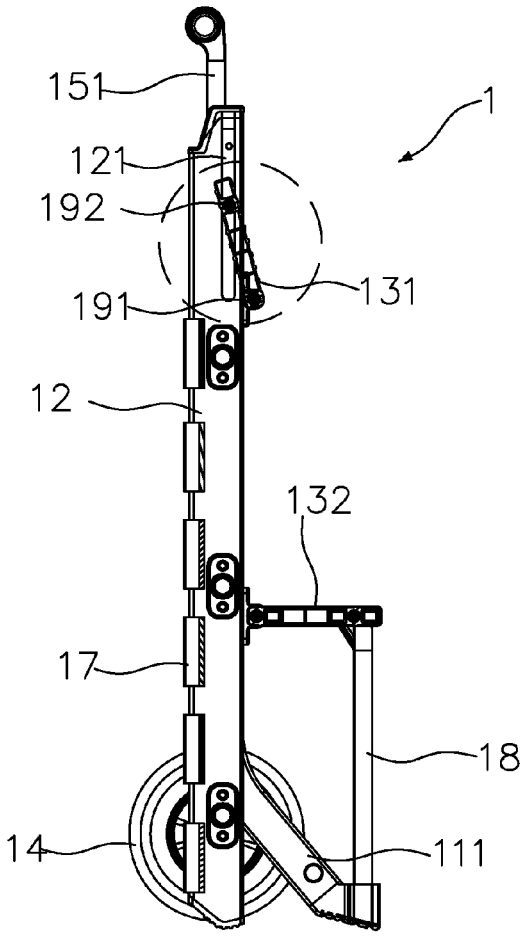
FIG. 8 is a schematic view showing the connecting structure of the front and rear support legs of the ladder assembly according to the preferred embodiment of the present invention (in a closed state)
Figure 8A:
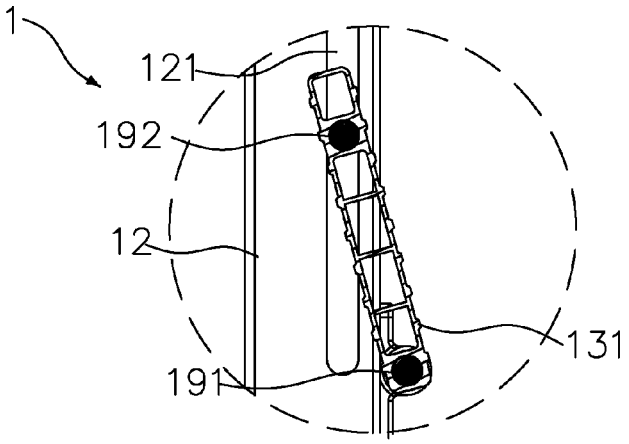
FIG. 8A is a partially enlarged view of FIG. 8.
Figure 9:
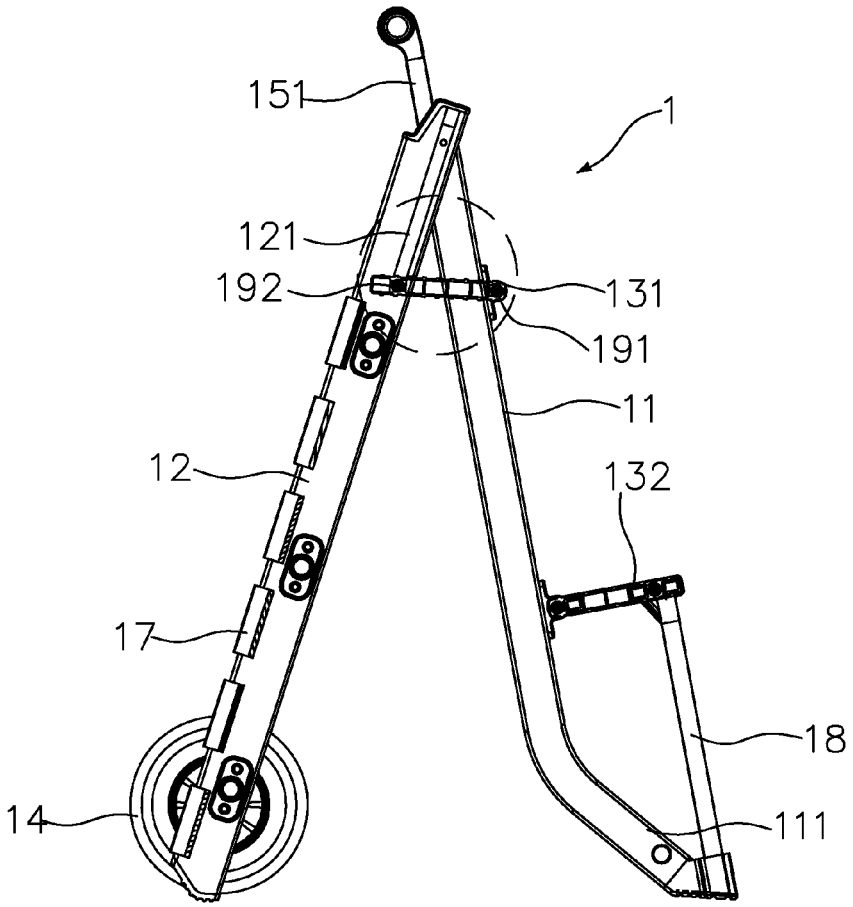
FIG. 9 is a schematic view showing the connecting structure of the front and rear support legs of the ladder assembly according to the preferred embodiment of the present invention (in an open state)
Figure 9A:
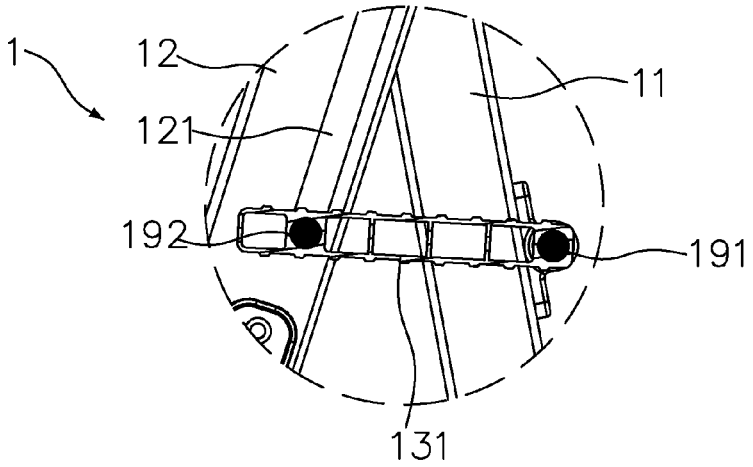
FIG. 9A is a partially enlarged view of FIG. 9.

Furthermore, a positioning structure is provided between the front and rear support legs for the front and rear legs to be unfolded or folded each other. As shown in FIG. 8 and FIG. 9, the positioning structure of the present invention cooperates with the upper footboard 131. The front side of the upper footboard 131 is provided with a fixing shaft 191. The rear side of the upper footboard 131 is provided with a slide shaft 192. The fixing shaft 191 is installed between the two front support legs 11. The two rear support legs 12 are provided with slide rails 121. The slide shaft 192 is installed in the slide rails 121. Through the slide shaft 192 to slide in the slide rails 121, referring to the FIG. 8A and FIG. 9A, the front and rear support legs 11, 12 are diverged and drawn close to each other.

Figure 10:
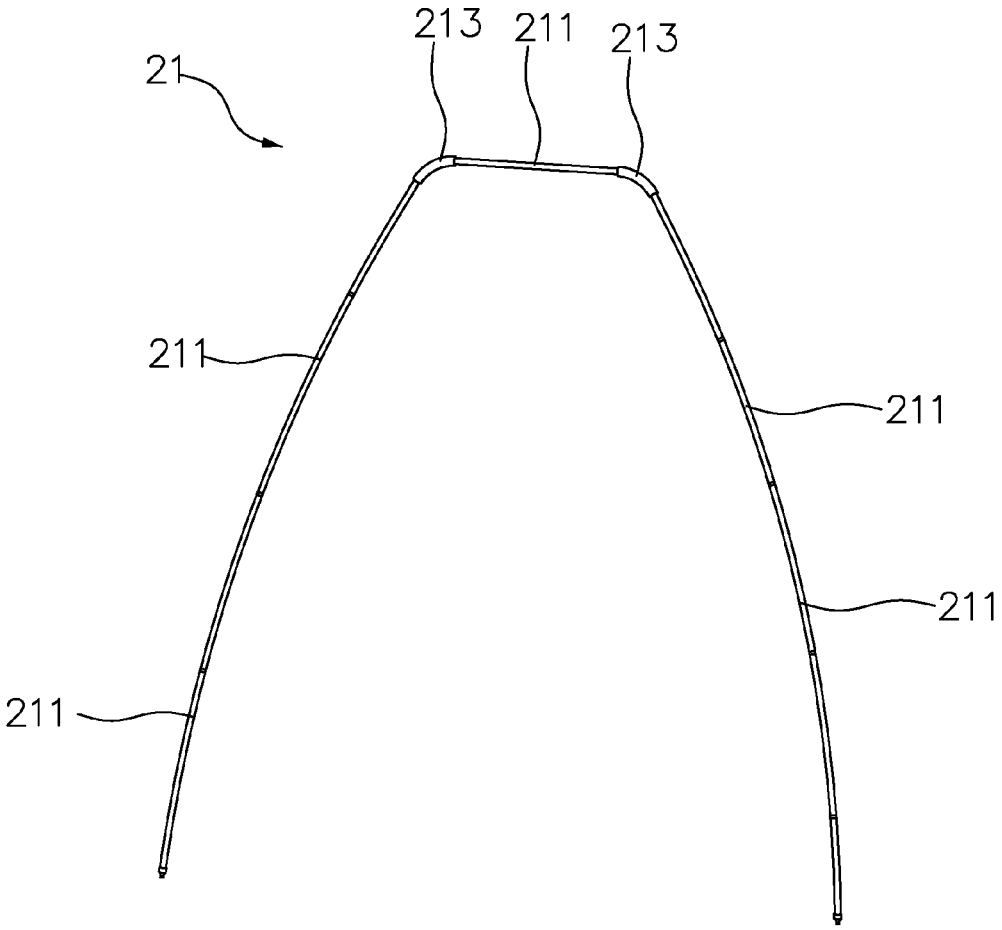
FIG. 10 is a perspective view showing the support rod of the affiliated tent according to the preferred embodiment of the present invention.
Figure 11:
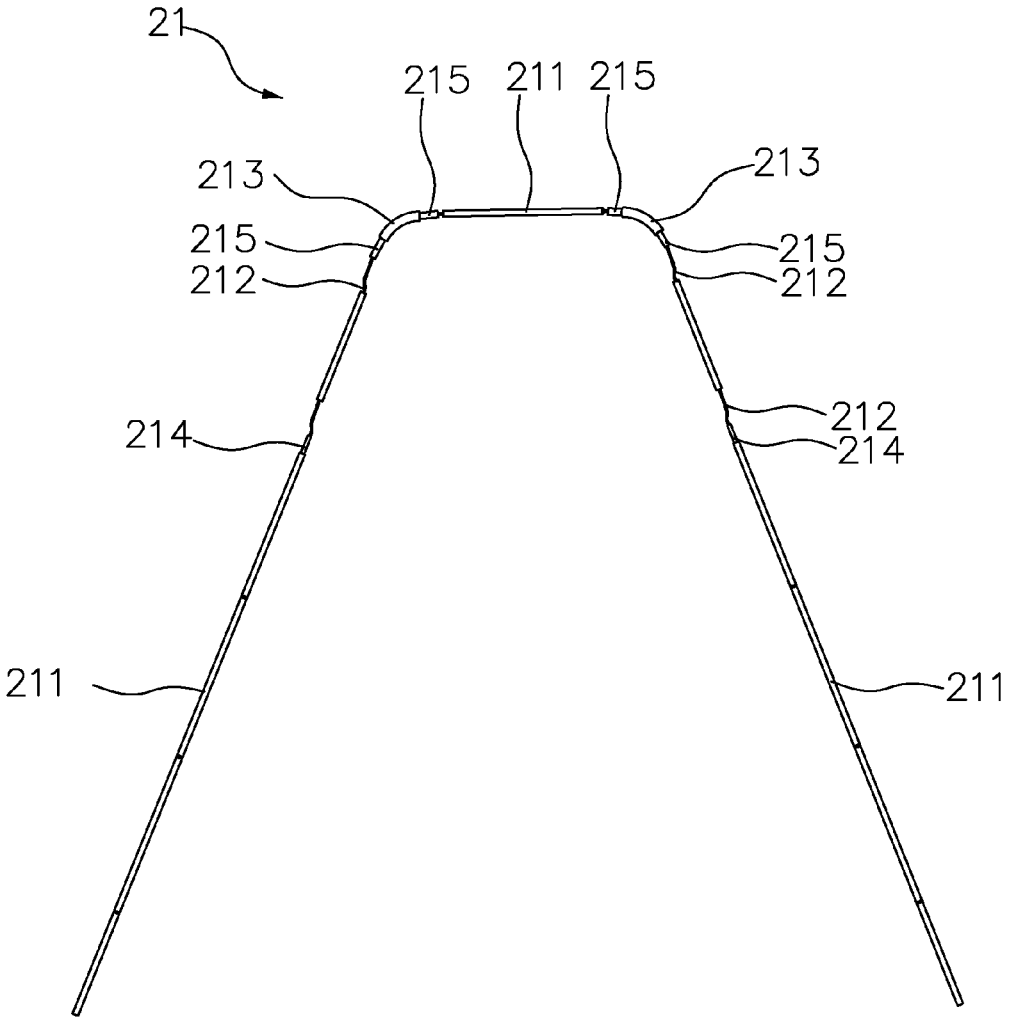
FIG. 11 is an exploded view showing the support rod of the affiliated tent according to the preferred embodiment of the present invention.

The connecting structure of the rod members 211 of the support rod 21 of the affiliated tent 2 is a common structure. One end of each rod member 211 is formed with a reduced neck section 214, referring to FIG. 10 and FIG. 11. When assembled, the reduced neck section 214 of one rod member 211 is inserted into a non-reduced end of another rod member 211 to achieve connection of two rod members 211. To dissemble the support rod 21, the rod members 211 are disengaged from each other. For a stable connection of the rod members 211, an elastic rope 212 is provided in the rod members 211. Two ends of the elastic rope 212 are fixed to the two ends of the entire support rod 21. After the rod members 211 are connected, the elastic rope 212 can prevent the rod members 211 from disengagement. The connection of the rod members 211 can be achieved by other complicated connecting structures. These connecting structures are common structures for tent rod members, and won't be described in detail herein.

Figure 12:
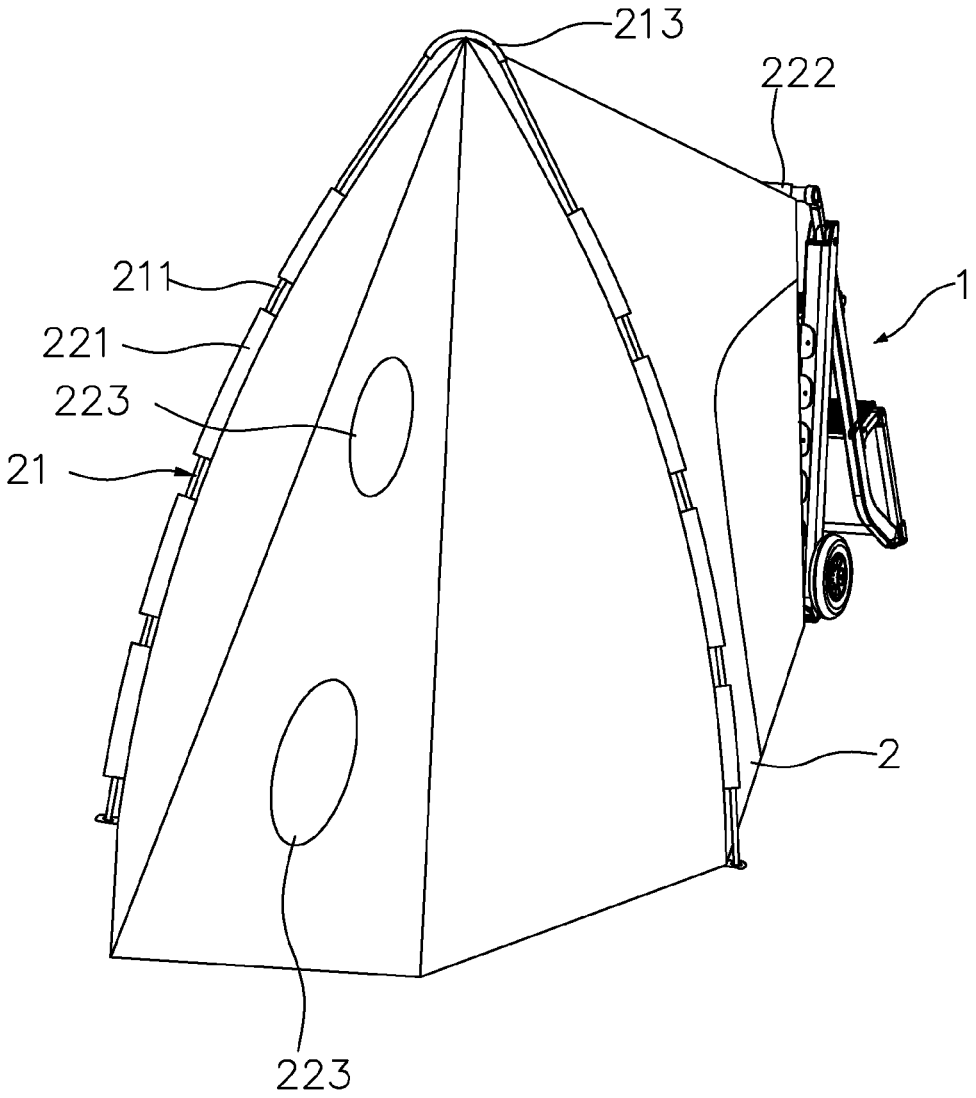
FIG. 12 is a schematic view showing another embodiment of the support rod of the affiliated tent.
Figure 13:
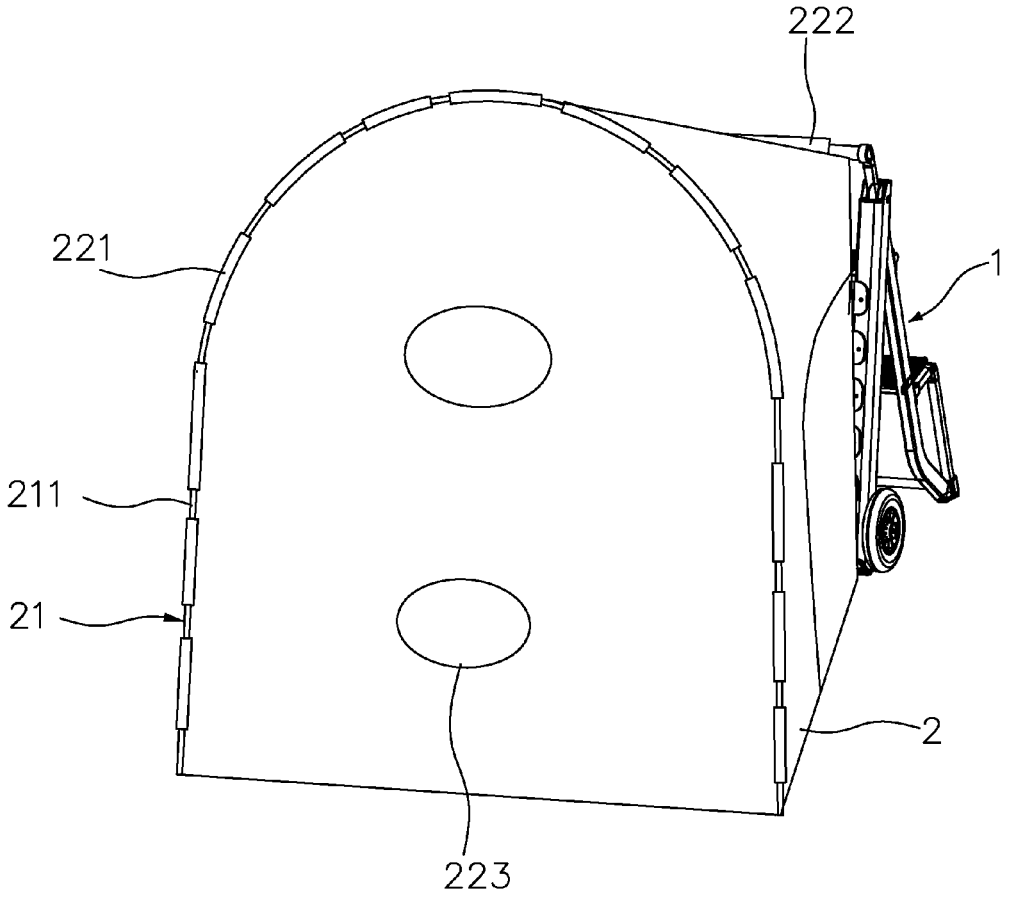
FIG. 13 is a schematic view showing a further embodiment of the support rod of the affiliated tent.

After bending, the support rod 21 is in an arcuate shape. On the one hand the shape of the product is single, and on the other hand the tension of the rod members is greater. For this purpose, a dual elbow connector 213 is provided to connect with the rod members 211. Two ends of the elbow connector 213 are formed with reduced neck sections 215 for connecting the elbow connector 213 with the rod members 211. With the elbow connector 213, the support rod 21 can be arranged in various shapes. As shown in FIG. 1, two ends of the top side of the support rod 21 are connected with two elbow connecters 213, such that the support rod 21 after connected is in a reverse trapezoid shape. As shown in FIG. 12, the center of the support rod 21 is connected with one elbow connecter 213, such that the support rod 21 after connected is in a reverse V shape. As shown in FIG. 13, without the elbow connecter 213, the support rod 21 is in a reverse U shape. In fact, the elbow connector is one of the aforesaid connecting structures.

Although particular embodiments of the present invention have been described in is detail for purposes of illustration, various modifications and enhancements may be made without departing from the spirit and scope of the present invention. Accordingly, the present invention is not to be limited except as by the appended claims.

What is claimed is:

1. A tent for photography, comprising a ladder assembly and an affiliated tent; the ladder assembly comprising two front support legs and two rear support legs, tops of the front support legs and the rear support legs being hinged together, at least one footboard being disposed on the front support legs or between the front support legs and the rear support legs; the affiliated tent comprising a support rod and a tent cloth; the support rod being composed of a plurality rod members connected with each other, two ends of the support rod after bending forming two support legs of the affiliated tent; one side of the tent cloth being fixed on the support rod, another side of the tent cloth being fixed on the ladder assembly, wherein bottoms of the front support legs or the rear support legs of the ladder assembly are provided with wheels, and the tops of the front and rear support legs are provided with a handle.

2. The tent for photography as claimed in claim 1, wherein the rear support legs are provided with straps, and a backboard is provided between the two rear support legs.

3. A tent for photography, comprising a ladder assembly and an affiliated tent; the ladder assembly comprising two front support legs and two rear support legs, tops of the front support legs and the rear support legs being hinged together, at least one footboard being disposed on the front support legs or between the front support legs and the rear support legs; the affiliated tent comprising a support rod and a tent cloth; the support rod being composed of a plurality rod members connected with each other, two ends of the support rod after bending forming two support legs of the affiliated tent; one side of the tent cloth being fixed on the support rod, another side of the tent cloth being fixed on the ladder assembly, wherein the ladder assembly is provided with two footboards, an upper footboard disposed between the front and rear support legs and a lower footboard disposed on the front support legs and protruding from front sides of the front support legs.

4. The tent for photography as claimed in claim 3, wherein a front side of the upper footboard is provided with a fixing shaft, a rear side of the upper footboard is provided with a slide shaft, the fixing shaft is installed between the two front support legs, the two rear support legs are provided with slide rails, and the slide shaft is installed in the slide rails.

5. The tent for photography as claimed in claim 4, wherein the rear support legs are provided with straps, and a backboard is provided between the two rear support legs.

6. The tent for photography as claimed in claim 3, wherein two supporting rods are provided under the lower footboard, lower ends of the front support legs have curved portions which are bent forward, and the supporting rods are sustained on the curved portions.

7. The tent for photography as claimed in claim 6, wherein the rear support legs are provided with straps, and a backboard is provided between the two rear support legs.

8. The tent for photography as claimed in claim 3, wherein the rear support legs are provided with straps, and a backboard is provided between the two rear support legs.

9. A tent for photography, comprising a ladder assembly and an affiliated tent; the ladder assembly comprising two front support legs and two rear support legs, tops of the front support legs and the rear support legs being hinged together, at least one footboard being disposed on the front support legs or between the front support legs and the rear support legs; the affiliated tent comprising a support rod and a tent cloth; the support rod being composed of a plurality rod members connected with each other, two ends of the support rod after bending forming two support legs of the affiliated tent; one side of the tent cloth being fixed on the support rod, another side of the tent cloth being fixed on the ladder assembly, wherein a handle is disposed on a retractable pull rod, the retractable pull rod is installed on the tops of the front support legs, and the rear support legs are provided with wheels.

10. The tent for photography as claimed in claim 9, wherein the rear support legs are provided with straps, and a backboard is provided between the two rear support legs.

11. The tent for photography as claimed in any one of claims 1, 3 and 9, wherein one end of each of the rod members is formed with a reduced neck section, the reduced neck section of one of the rod member is inserted into a non-reduced end of another one of the rod members for connection of the rod members, an elastic rope is provided in the rod members, and two ends of the elastic rope are fixed to the two ends of the support rod.

12. The tent for photography as claimed in claim 11, wherein the support rod is provided with at least one elbow connector, and two ends of the elbow connector are formed with reduced neck sections to connect the adjacent rod members.

13. The tent for photography as claimed in any one of claims 1, 3 and 9, wherein the rod members of the support rod of the affiliated tent are connected through a connecting structure.

* * * * *